US007240511B2

(12) United States Patent
Lee et al.

(10) Patent No.: US 7,240,511 B2
(45) Date of Patent: Jul. 10, 2007

(54) COLD AIR PATH STRUCTURE OF REFRIGERATOR

(75) Inventors: Myung Ryul Lee, Seongnam-si (KR); Sung Hoon Chung, Seoul (KR); Seong Jae Kim, Ansan-si (KR); Chang Ho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 157 days.

(21) Appl. No.: 11/043,968

(22) Filed: Jan. 28, 2005

(65) Prior Publication Data

US 2005/0183441 A1 Aug. 25, 2005

(30) Foreign Application Priority Data

Jan. 28, 2004 (KR) ..... 10-2004-0005382

(51) Int. Cl.
*F25C 1/12* (2006.01)

(52) U.S. Cl. ..... 62/353; 62/420

(58) Field of Classification Search ..... 62/340–356, 62/404–426

See application file for complete search history.

(56) References Cited

U.S. PATENT DOCUMENTS 3,122,005 A * 2/1964 Costantini et al. ..... 62/419
3,359,751 A * 12/1967 Stevens ..... 62/186
3,902,331 A * 9/1975 True et al. ..... 62/137
4,732,009 A * 3/1988 Frohbieter ..... 62/89
5,355,686 A * 10/1994 Weiss ..... 62/89
5,816,060 A * 10/1998 Brownell et al. ..... 62/186

* cited by examiner

*Primary Examiner*—William E. Tapolcai
(74) *Attorney, Agent, or Firm*—Birch, Stewart, Kolasch & Birch, LLP

(57) ABSTRACT

A cold air path structure of a refrigerator is provided. The cold air path structure defines a passage from an ice machine installed in a freezing chamber to a chilling chamber in order to discharge an cold air used to freeze water of the ice machine to the chilling chamber, such that new cold air can be smoothly supplied to the ice machine, thereby increasing the efficiency of the ice machine. Further, an additional air passage is not required to supply the cold air to the chilling chamber, thereby simplifying the structure of the refrigerator and decreasing power consumption.

15 Claims, 13 Drawing Sheets

COLD AIR PATH STRUCTURE OF REFRIGERATOR

BACKGROUND OF THE INVENTION

1. Field of the Invention

The present invention relates to a refrigerator with an ice machine, and more particularly, to a cold air path structure in a side-by-side refrigerator with an ice machine installed inside of a freezing chamber door.

2. Description of the Related Art

Generally, a refrigerator is a machine for keeping food fresh for a predetermined time or freezing the food, in which a refrigerating cycle of compression, condensation, expansion and evaporation is repeated. The refrigerator is one of the living necessities.

In recent years, the size of the refrigerator has been increased, and various types of refrigerators such as a side-by-side refrigerator have been developed to satisfy consumer's demand.

Such a side-by-side refrigerator includes a freezing chamber and a chilling chamber to provide freezing and chilling functions. Further, the side-by-side refrigerator includes an ice machine capable of making ice, and storing and discharging the ice.

However, since the ice machine is installed inside of the freezing chamber door of the side-by-side refrigerator, the cold air discharged from an ice maker of the ice machine is recirculated through the freezing chamber, decreasing the ice-making performance.

Further, it is needed to define a cold air passage to the chilling chamber to send the cold air to the chilling chamber, requiring an additional duct and fan.

SUMMARY OF THE INVENTION

Accordingly, the present invention is directed to a cold air path structure of a refrigerator that substantially obviates one or more problems due to limitations and disadvantages of the related art.

An object of the present invention is to provide a cold air path structure of a refrigerator, which defines a cold air passage from an ice machine installed in a freezing chamber to a chilling chamber, such that a cold air used in the ice machine can be discharged to the chilling chamber.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cold air path structure of a refrigerator having an barrier to define a freezing chamber and a chilling chamber and an ice machine inside of a freezing chamber door, including: a cold air outlet duct defined at the ice machine to discharge an cold air from the ice machine; a cold air supplying duct defined in the barrier to supply the cold air from the cold air outlet duct to the chilling chamber; and a packing member for sealing a joint between the cold air outlet duct and the cold air supplying duct.

In another aspect of the present invention, there is provided a cold air path structure of a refrigerator having an barrier to define a freezing chamber and a chilling chamber and an ice machine inside of a freezing chamber door, including: a cold air outlet duct defined from the ice machine into a freezing chamber door; a cold air supplying duct defined in a chilling chamber door to supply an cold air from the cold air outlet duct to the chilling chamber; and a packing member for sealing a joint between the cold air outlet duct and the cold air supplying duct.

In a further another aspect of the present invention, there is provided a cold air path structure of a refrigerator, including: a refrigerator body divided into a freezing chamber and a chilling chamber; an ice machine installed in the refrigerator body for freezing water; and a cold air duct connecting the ice machine and the chilling chamber to supply an cold air used to freeze water of the ice chamber to the chilling chamber.

According to the present invention, the cold air used in the ice machine is supplied to the chilling chamber, thereby increasing the efficiency of refrigerator.

Further, the cold air path is defined in the barrier and the freezing and chilling doors, thereby increasing available spaces in the freezing and chilling chambers.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
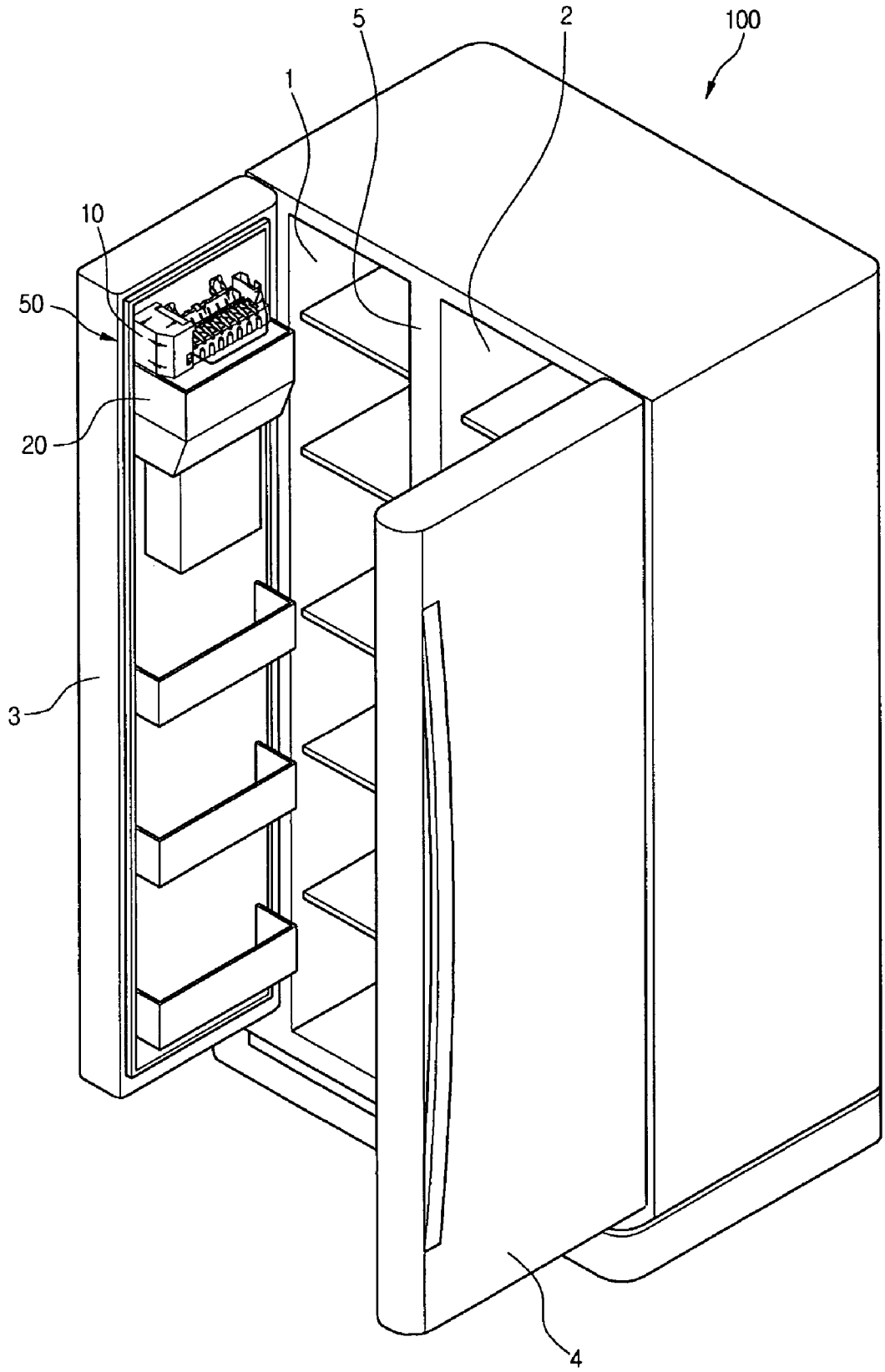
FIG. 1 is a perspective view of a refrigerator with an ice machine.
Figure 2:
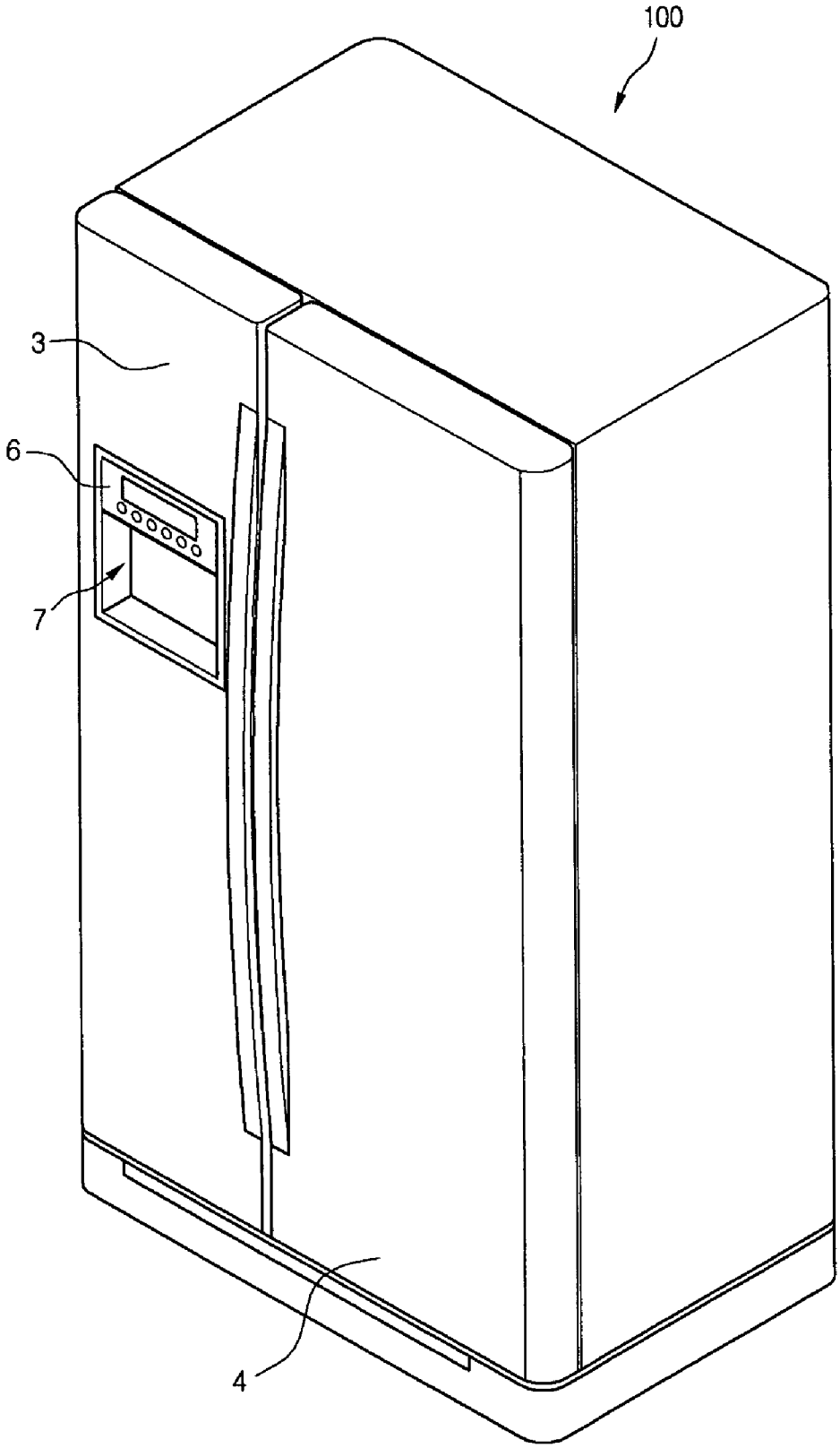
FIG. 2 is a perspective view of the refrigerator depicted in FIG. 1 when doors of the refrigerator is closed and a dispenser is shown on the front.

FIG. 1 is a perspective view of a refrigerator with an ice machine, and FIG. 2 is a perspective view of the refrigerator depicted in FIG. 1 when doors of the refrigerator are closed and a dispenser is shown on the front.

Referring to FIGS. 1 and 2, a refrigerator 100 is divided into a freezing chamber 1 and a chilling chamber 2, and includes a freezing chamber door 3 and a chilling chamber door 4. An ice machine 50 is installed inside of the freezing chamber door 3, and a control panel 6 is installed at a front of the freezing chamber door 3 for the user to select menus.

The ice machine 50 includes an ice maker 10 for making ice and an ice bank 20 for storing the ice. Further, the ice machine 50 includes an ice carrier for carry the ice from the ice bank 20 to the outside of the refrigerator 100 and a dispenser 7 from which the user can pick out the ice.

Figure 3:
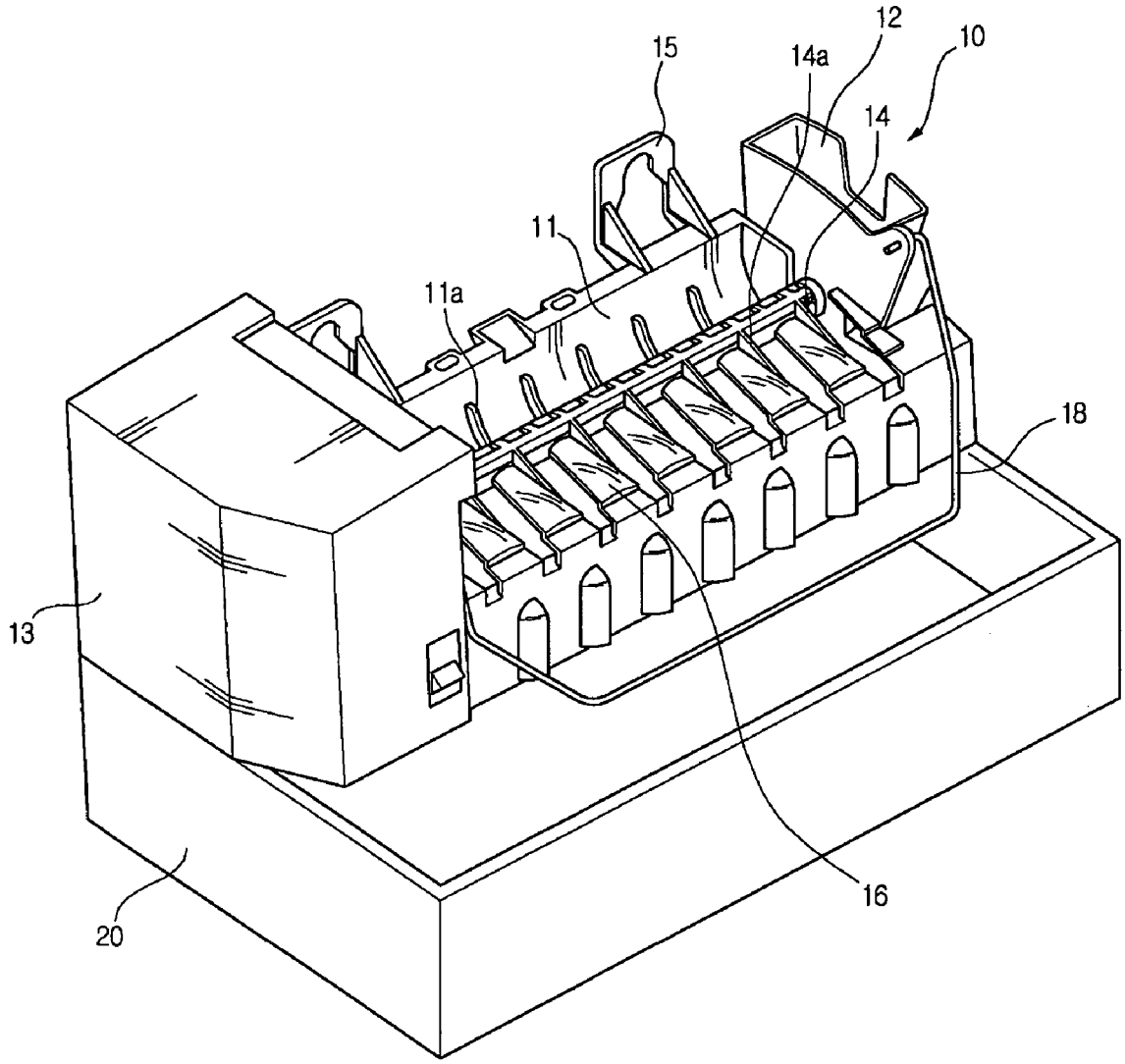
FIG. 3 is a perspective view of an ice machine installed inside of a freezing chamber door of the refrigerator depicted in FIG. 1.
Figure 4:
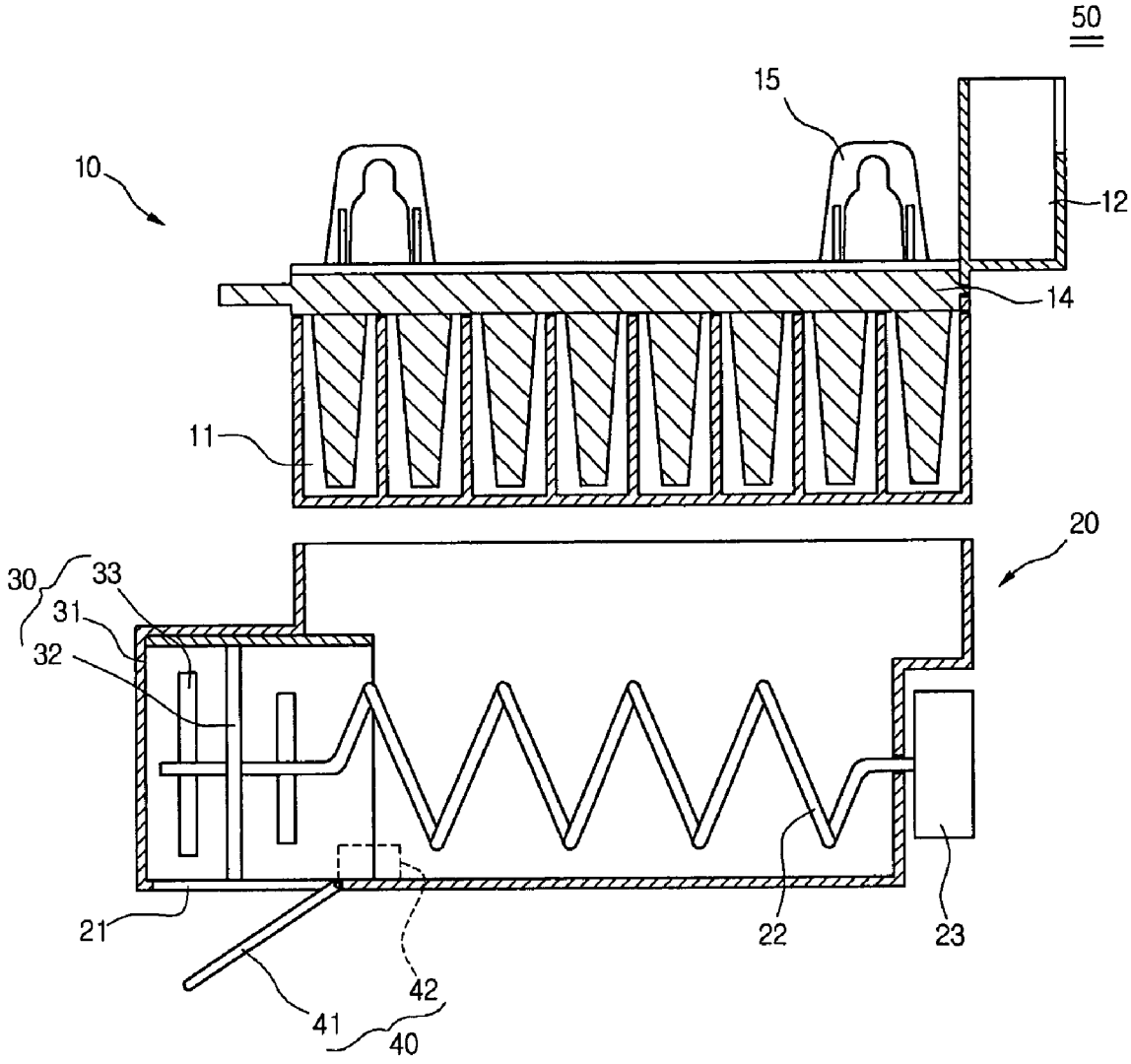
FIG. 4 is a longitudinal sectional view of the ice machine depicted in FIG. 3, in which an ice carrier is installed in an ice bank.

FIG. 3 is a perspective view of an ice machine installed inside of a freezing chamber door of the refrigerator depicted in FIG. 1; FIG. 4 is a longitudinal sectional view of the ice machine depicted in FIG. 3, in which an ice carrier is installed in an ice bank; and FIG. 5 is a cross sectional view of the ice machine depicted in FIG. 3, showing an ice discharge from an ice maker to an ice bank.

Figure 5:
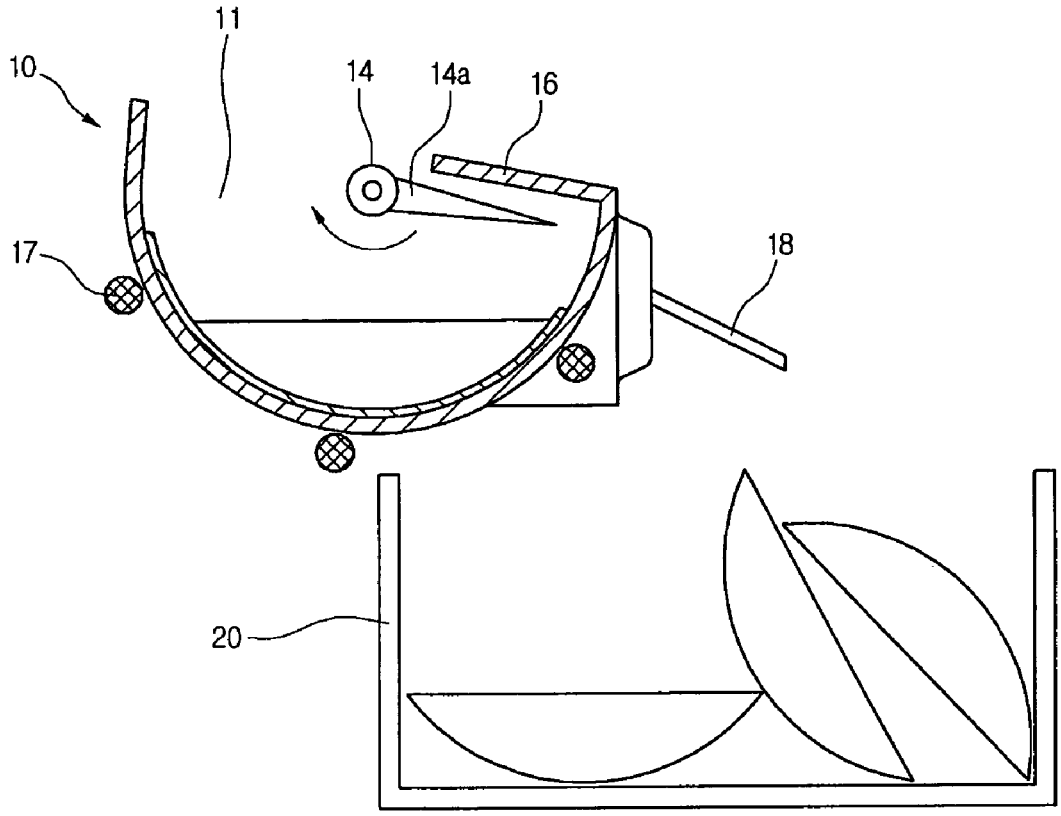
FIG. 5 is a cross sectional view of the ice machine depicted in FIG. 3, showing an ice discharge from an ice maker to an ice bank.

Referring to FIGS. 3 to 5, the ice maker 10 includes a mold 11 in which water is frozen and a water feeder 12 formed at one side of the mold to feed the water to the mold 11.

The mold 11 defines a semi-cylindrical cavity, and barrier ribs 11*a* are uniformly formed in the cavity to divide the cavity into compartments. Coupling parts 15 are formed to fix the ice machine 50 to the freezing chamber door 3 On the back of the mold 11, and a driving part 13 is disposed at the other side of the mold 11. The driving part includes a motor of which shaft is coupled with an ejector 14.

The ejector 14 includes a rod disposed through the axis of the mold 11, and a plurality of ejector fin 14*a* protruded vertically from the rod with a uniformly spaced relationship therebetween. The ejector fins 14*a* are disposed in the compartments of the mold 11, respectively.

A plurality of slide bars 16 extend from a front edge of the mold 11 toward the rod of the ejector 14.

Also, heating elements 17 are attached under the mold 11 to slightly melt the ice in the mold 11 to easily separate the ice from the mold 11.

The ice maker 10 includes a rotatable arm 18 to check whether the ice bank 20 is fully filled with the ice. The arm 18 is connected with a controller that is disposed in the driving part 13. That is, the amount of the ice in the ice bank 20 can be controlled by the arm 18 and controller.

The ice bank 20 includes an ice carrier 22 and an ice discharge hole 21 at an end of the ice carrier 22, and the top of the ice bank 20 is opened to receive the ice dropping from the ice maker 10.

Also, the ice bank 20 includes a motor 23, an ice crusher 30, and an ice discharger 40.

The ice carrier 22 has a sawtooth shape and runs through the ice bank 20. The ice carrier 22 is coupled with the shaft of the motor 23, such that the ice carrier 22 moves the ice toward the ice crusher 30 upon the rotation of the motor 23.

The ice crusher 30 includes a housing 31, a fixed blade 32, and moving blades 33. The housing 31 has a hollow cylindrical shape with an opening. The fixed blade 32 is disposed across the inside of the housing 31, and the end of the ice carrier 22 is rotatably inserted through the fixed blade 32. The moving blades 33 are fixed to the end of the ice carrier 22, with disposing the fixed blade 32 therebetween. The number of moving blade 33 may be at least one.

The ice discharger 40 includes a plate shutter 41 and a solenoid 42. The shutter 41 is disposed at the ice discharge hole 21 to open the ice discharge hole 21 at a predetermined angle. The solenoid 42 is connected with the shutter 41.

The ice discharge hole 21 of the ice bank 20 is connected with the dispenser 7 exposed outside. The dispenser 7 includes an ambient air blocking unit to prevent the ambient air from coming into the refrigerator 100 when the ice is not discharged from the ice bank 20.

The operation of the ice machine 50 will now be described.

When it is determined using the arm 18 that the ice bank 20 not filled with ice, the ice maker 10 supplies water to the water feeder 12 until the mold 11 is filled with the water to a desired level. A surrounding cold air freezes the water in the mold 11. Herein, since the mold 11 is divided by the barrier ribs 11*a*, the ice in the mold 11 can be divided with a predetermined size.

After the ice is formed, the heating elements 17 heat the mold 11 for a short time to melt the contact surface of the ice. The driving part 13 rotates the ejector 14 to eject the ice from the mold 11. The ejected ice drops to the ice bank 20.

The making of the ice is repeated until the ice bank 20 is filled up to a predetermined level, and the controller terminates the operation of the ice maker 10. Also, when it is detected that the amount of the ice in the ice bank is smaller than a predetermined quantity, the ice making operation of the ice maker 10 is restarted, such that the amount of the ice in the ice bank 20 can be constantly maintained.

The user can manipulate the control panel 6 to receive the ice at the dispenser 7 from the ice bank 20, and the ice can be discharged after crushed at the ice crusher 30. That is, the user can select crushed ice or non-crushed ice.

The ice machine 50 is protruded from the inside surface of the freezing chamber door 3. Further, the ice machine 50 can be installed inside of a freezing chamber door liner without protrusion.

To discharge the cold air used to freeze the water in the ice machine 50 to the chilling chamber 2 instead of discharging the cold air to the freezing chamber, a cold air passage from the ice machine 50 to the chilling chamber is provided according to the present invention. The cold air passage will not be described with reference to the accompanying drawings.

Figure 6:
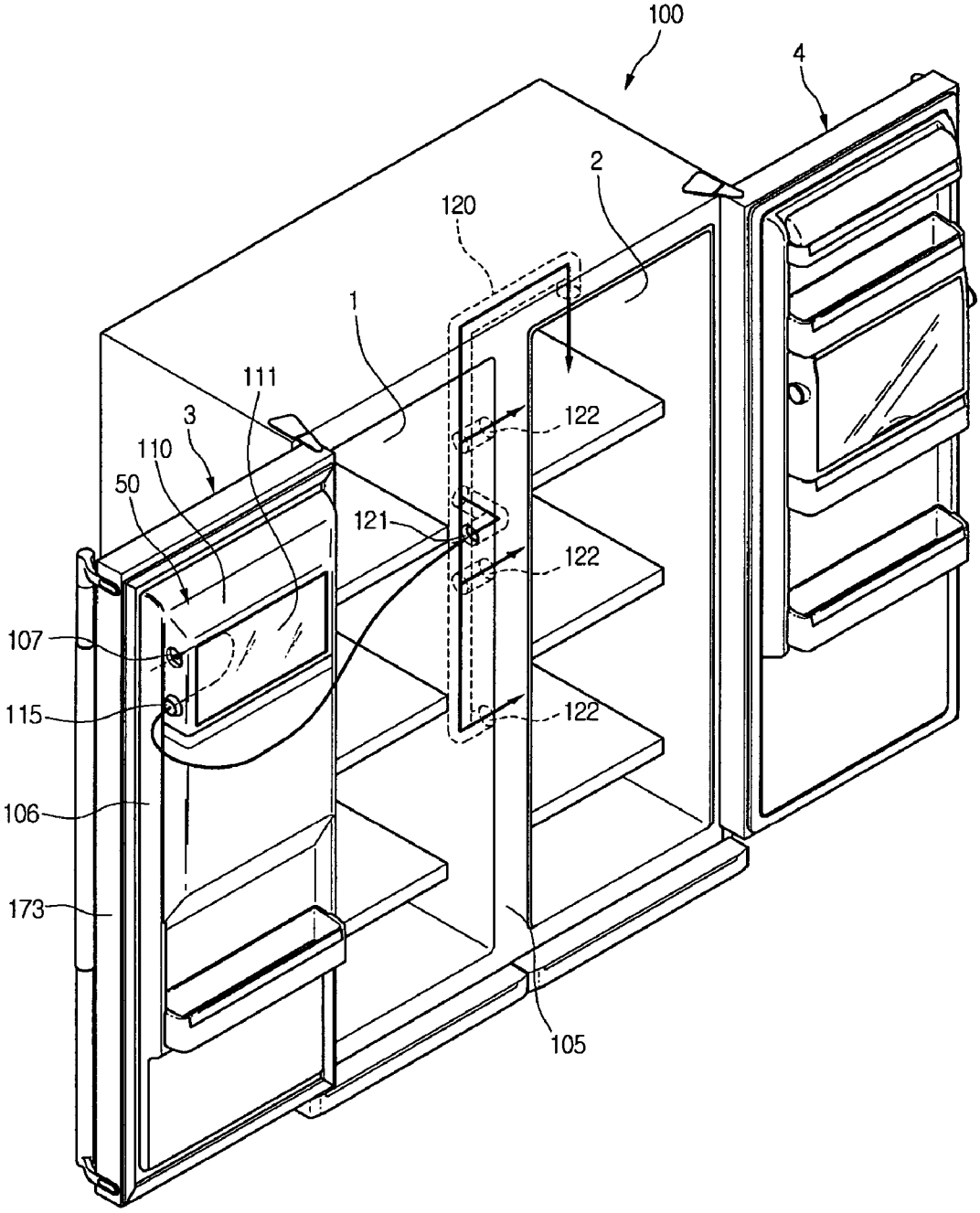
FIG. 6 is a perspective view of a refrigerator having a cold air path structure according to an embodiment of the present invention.
Figure 7:
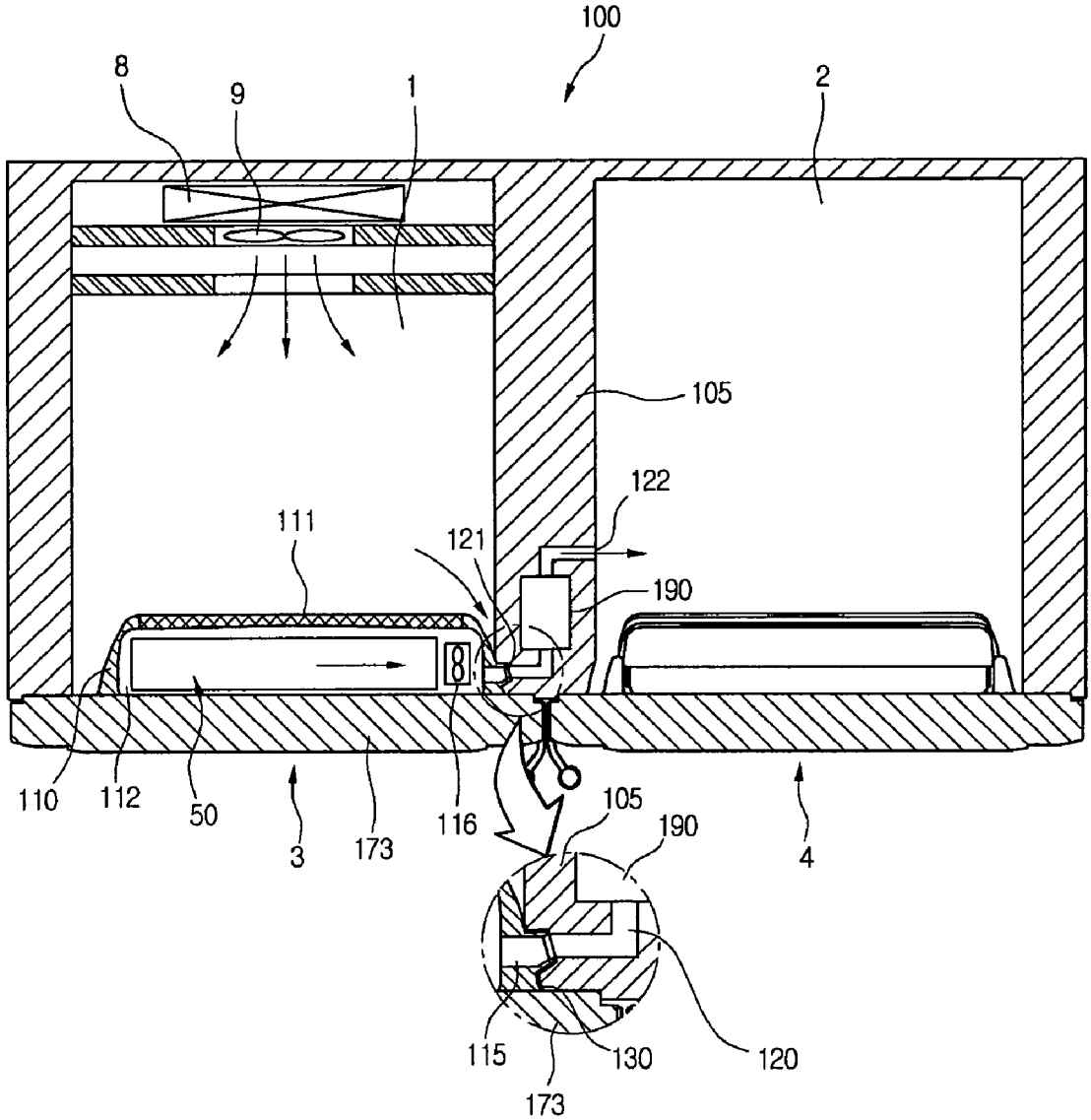
FIG. 7 is a cross sectional view of the refrigerator depicted in FIG. 6.

FIG. 6 is a perspective view of a refrigerator having a cold air path structure according to an embodiment of the present invention, and FIG. 7 is a cross sectional view of the refrigerator depicted in FIG. 6.

Referring to FIGS. 6 and 7, a side-by-side refrigerator 100 includes a barrier 105, a freezing chamber 1 and a chilling chamber 2 that are divided by the barrier 105, a freezing chamber door 3, a chilling chamber door 4, and an ice machine 50 installed inside of the freezing chamber door 3.

The ice machine 50 includes an ice maker 10 and an ice bank 20 (refer again to FIG. 5). In the ice maker 10, a cold air cooled at an evaporator 8 and blown by a blower fan 9 is circulated to make ice. The ice is ejected from the ice maker 10 to the ice bank 20.

An ice machine cover 110 surrounds the ice machine 50 installed inside of the freezing chamber door 3, and an openable mold cover 111 is attached at the front of the ice machine cover 110 to protect the inside ice machine 50.

The ice machine cover 110 defines a first cold air inlet hole 107 and a cold air outlet duct 115. An cold air in the freezing chamber 1 enters an ice-making chamber 112 of the ice machine 50 through the first cold air inlet hole 107, and the cold air leaves the ice-making chamber 112 through the cold air outlet duct 115.

The first cold air inlet hole 107 and the cold air outlet duct 115 may be defined in a freezing chamber door liner 106 or a freezing chamber door dike 173.

A blower fan 116 is installed in the ice machine cover 110 to easily discharge the cold air from the ice-making chamber 112 to the chilling chamber 2 through the cold air outlet duct and the barrier 105.

The barrier 105 defines a second cold air inlet hole 121, a cold air supplying duct 120, and a plurality of second cold air discharge holes 122. The second cold air inlet hole 121 comes into contact with the cold air outlet duct 115 of the ice machine cover 110. The second cold air discharge holes 122 communicate upper/middle/lower parts of the chilling chamber 2.

The cold air supplying duct 120 runs along the barrier 105 and top wall of the chilling chamber 2. The cold air used at the ice machine 50 is discharged to the cold air supplying duct 120 through the cold air outlet duct 115, and then evenly discharged to the chilling chamber 2.

Referring again to FIG. 7, after freezing the water in the ice machine 50, the cold air is discharged evenly to the chilling chamber 2 through the cold air outlet duct 115, the second cold air inlet hole 121, the cold air supplying duct 120, and the plurality of the second cold air discharge holes 122. A damper 190 is installed in the cold air supplying duct 120 to control the amount of the cold air flowing from the ice machine 50 to the chilling chamber 2.

The second cold air discharge holes 122 are defined at upper, middle, lower location of the barrier 105 to evenly distribute the cold air to the chilling chamber 2. The second cold air discharge holes 122 communicate with the chilling chamber 2, such that the cold air discharged from the ice machine 50 can be evenly distributed to the chilling chamber 2 through the cold air supplying duct 120 and the second cold air discharge holes 122.

Therefore, the cold air blown to the freezing chamber 1 from the rear blower fan 9 is directed to the ice machine 50. In the ice machine 50, the cold air circulated through the ice-making chamber 112 to freeze the water in the ice maker 10 and then blown to the cold air outlet duct 115 by the blower fan 116 disposed at a bottom of the ice bank 20.

Then, the cold air passes through the cold air outlet duct 115 and the second cold air inlet hole 121 that is abutted on the cold air outlet duct 115. The cold air passed the second cold air inlet hole 121 flows along the cold air supplying duct 120 to reach the damper 190 where the flow of the cold air is controlled. After leaving the damper 190, the cold air flows to the plurality of the second cold air discharge holes that are branched off from the cold air supplying duct 120.

There may be at least one blower fan and damper along the cold air passage formed through the ice machine 50, the cold air outlet duct 115, the cold air supplying duct, and the chilling chamber.

Meanwhile, the cold air outlet duct 115 may be formed in the freezing chamber door liner 106 to discharge the cold air from the ice machine 50 to the chilling chamber 2.

Figure 8:
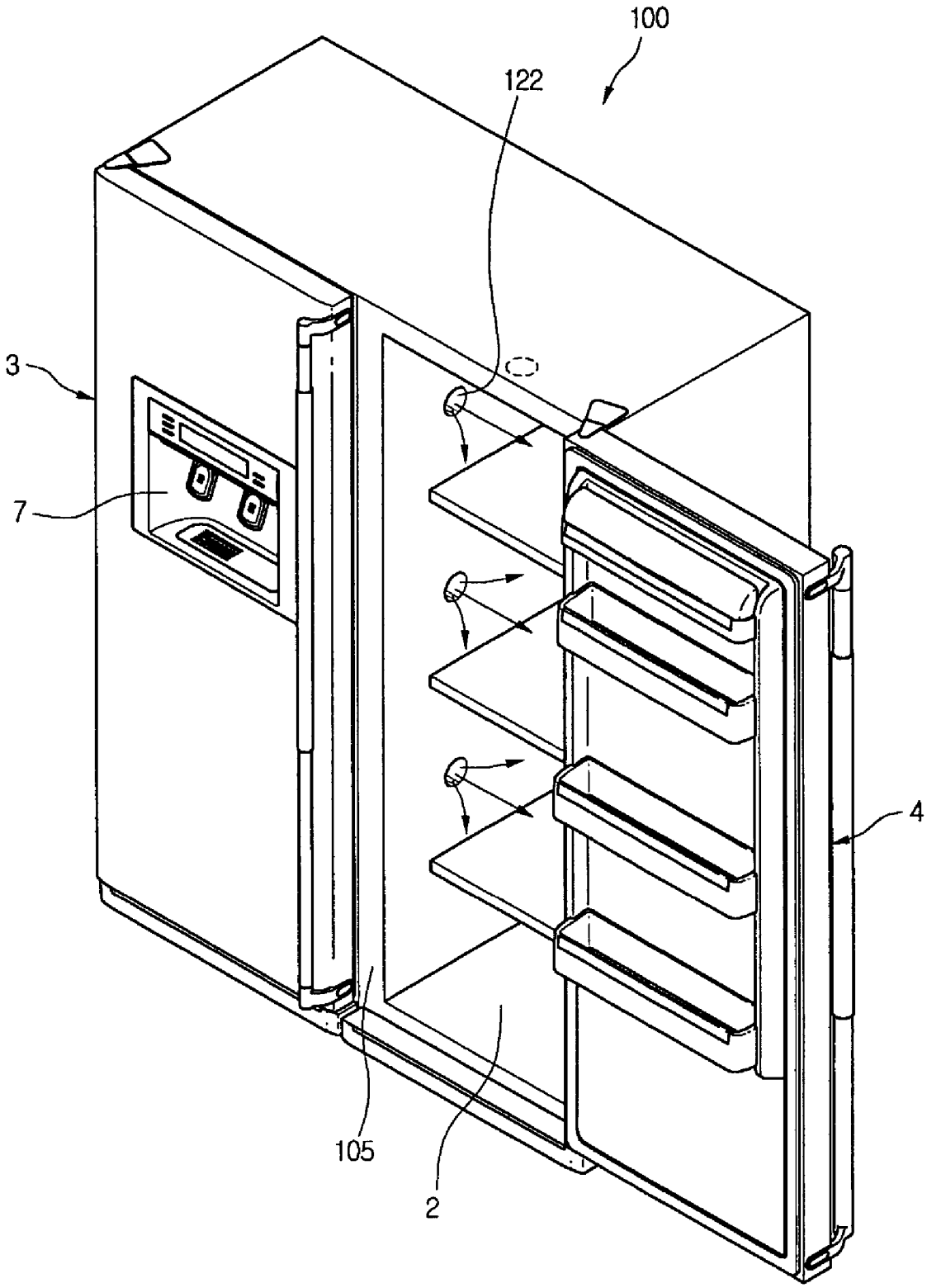
FIG. 8 is a perspective view of the refrigerator depicted in FIG. 6, showing a cold air discharge from an ice machine to a chilling chamber.
Figure 9:
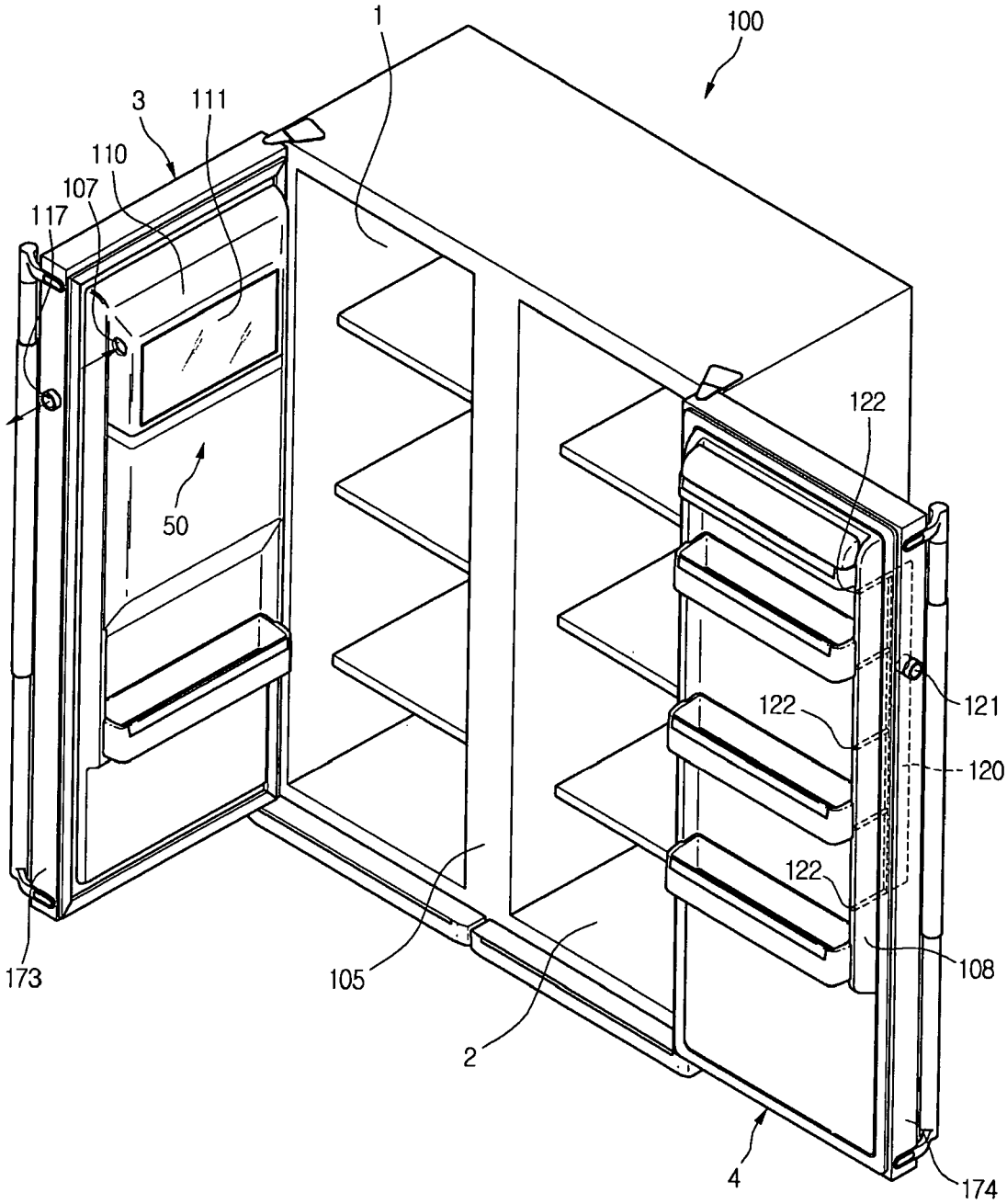
FIG. 9 is a perspective view of a refrigerator having a cold air path structure according to another embodiment of the present invention.
Figure 10:
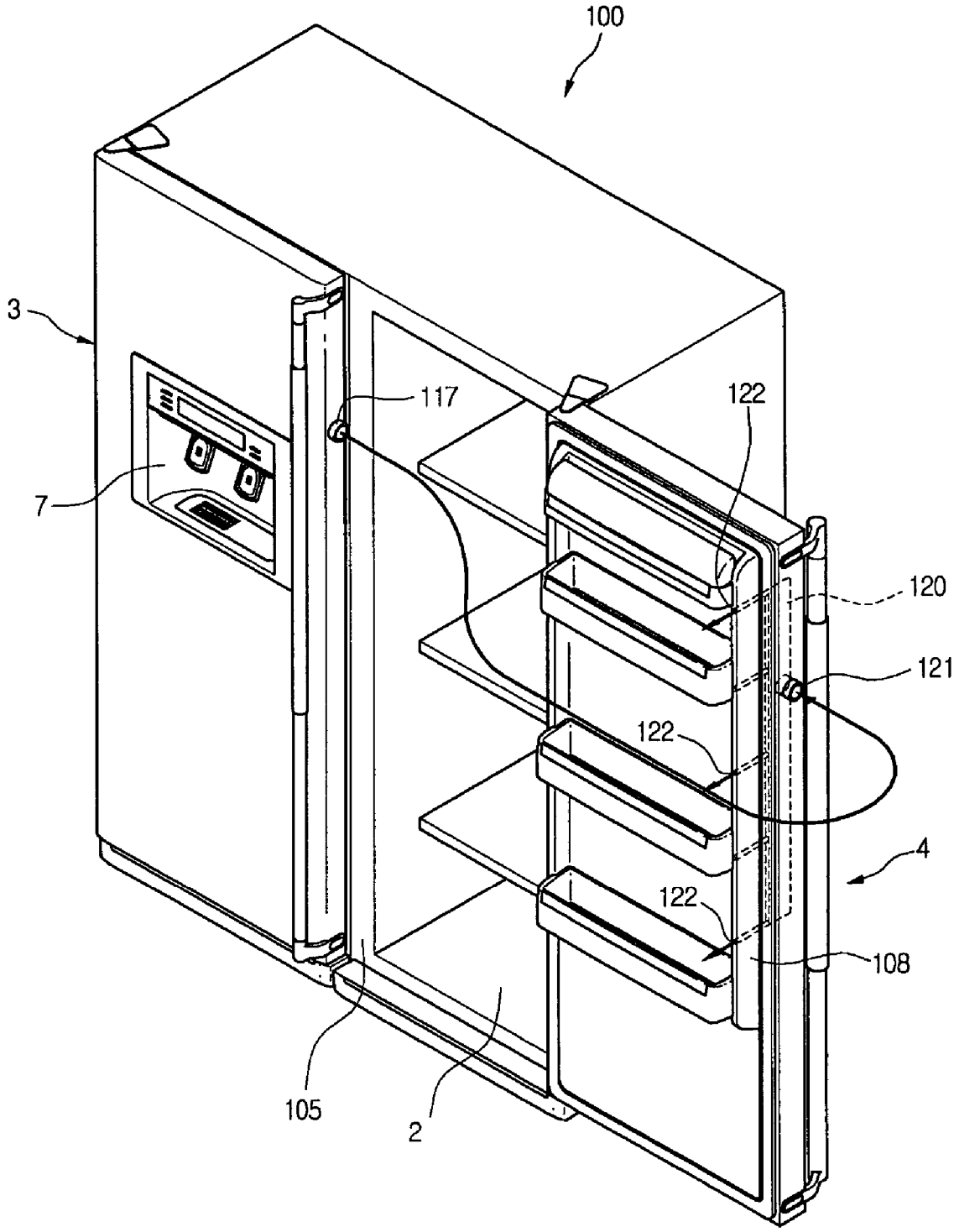
FIG. 10 is a perspective view of the refrigerator depicted in FIG. 9, showing a cold air discharge from an ice machine to a chilling chamber.
Figure 11:
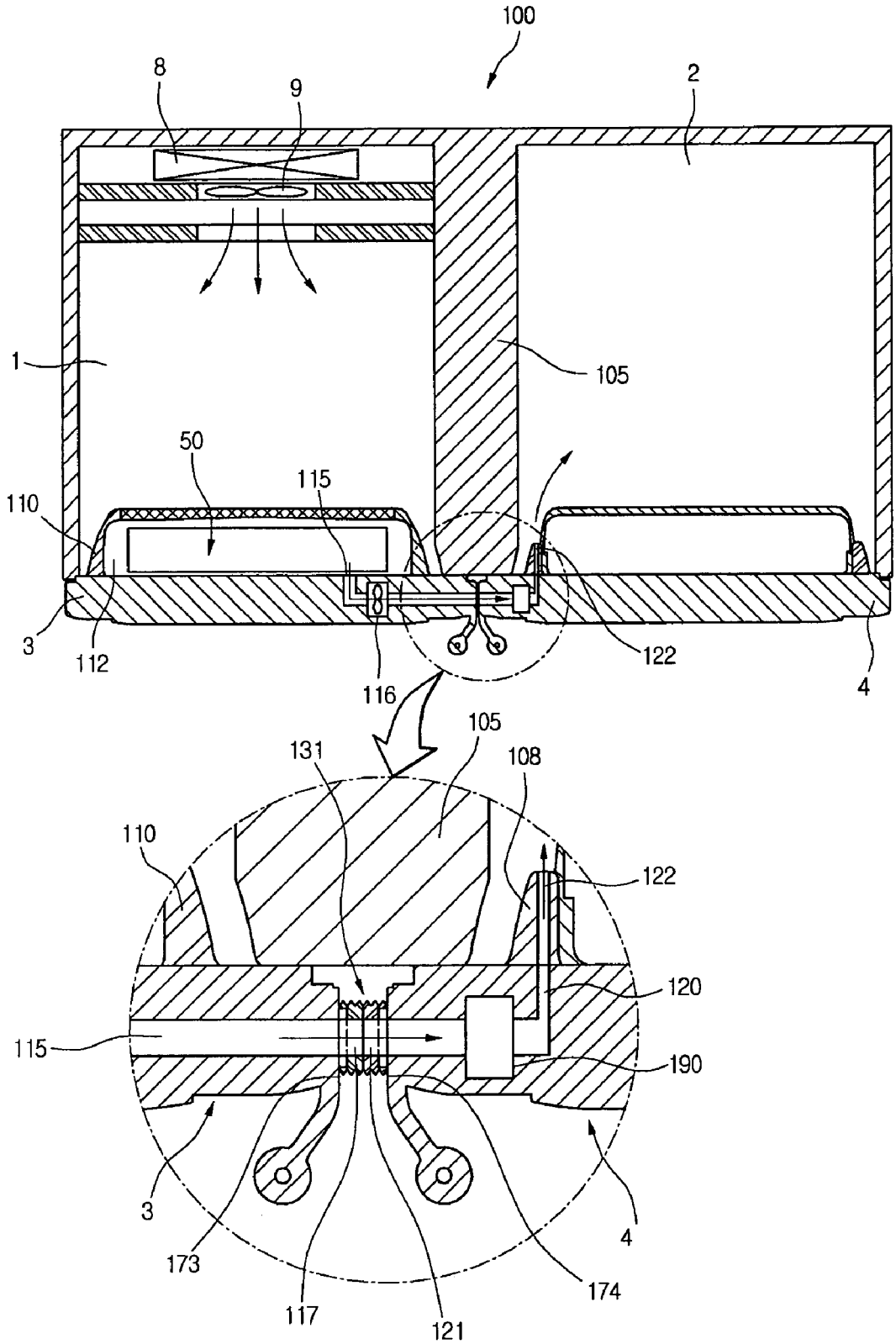
FIG. 11 is a cross sectional view of the refrigerator depicted in FIG. 9.
Figure 12:
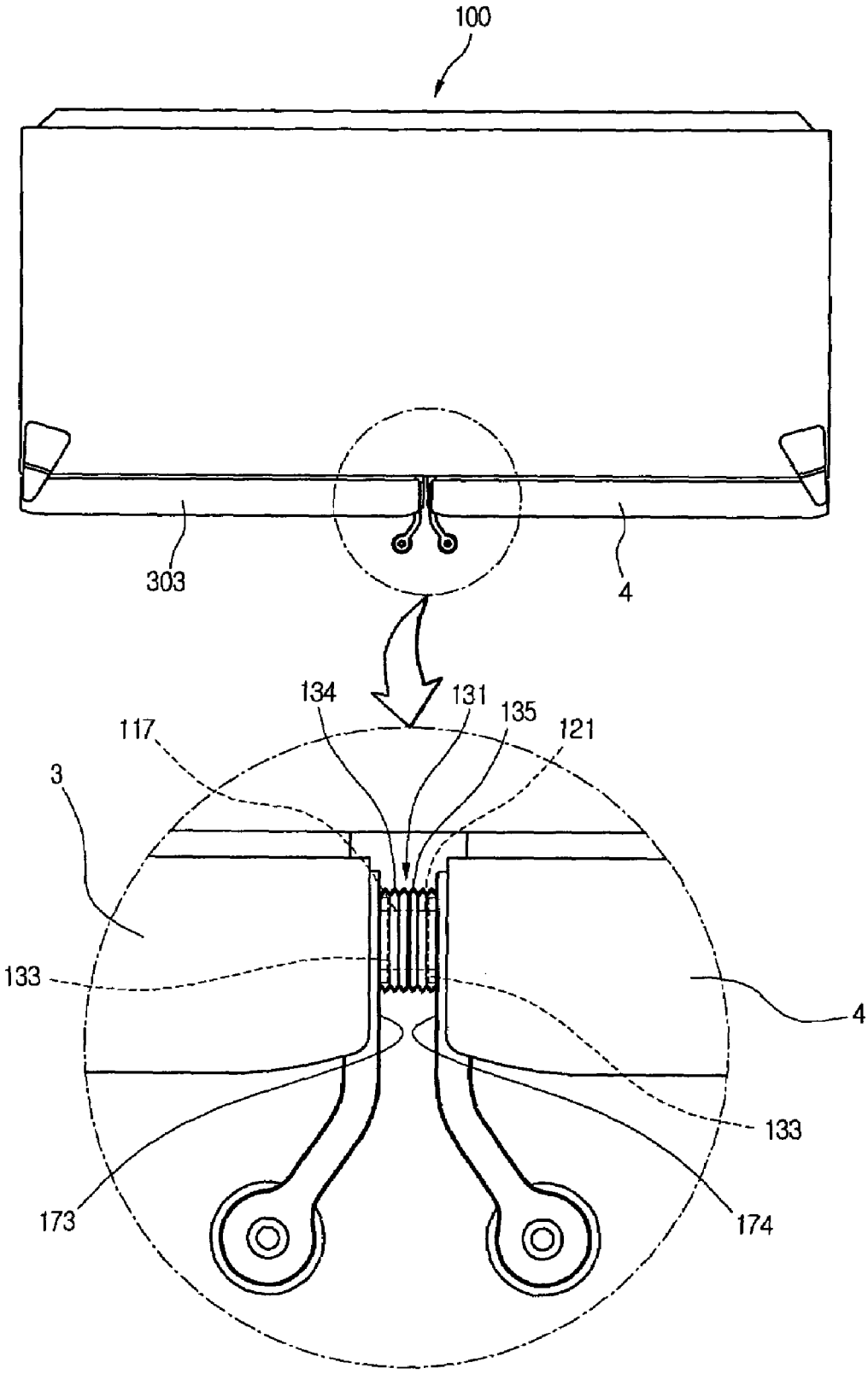
FIG. 12 is a plain view of the refrigerator depicted in FIG. 9, showing a packing member.

The joint between the cold air outlet duct 115 and the cold air supplying duct 120 may have a concave or convex shape. That is, the exit end of the cold air outlet duct 115 may have the concave shape or convex shape and the second cold air inlet hole 121 may have corresponding shape in order to prevent cold air leakage when they are brought into contact with each other. The cold air discharged from the ice machine 50 passes through the cold air outlet duct 115 and the cold air supplying duct 120 and then enters the chilling chamber 2 through the plurality of second cold air discharge holes 122, such the cold air can be uniformly distributed through the chilling chamber 2 (refer to FIG. 8).

Further, a packing member 130 is provided around the joint between the cold air outlet duct 115 and the cold air supplying duct 120 in order to hermetically seal the joint without cold air leakage. For example, the packing member may be made of rubber to securely seal the joint. The cold air supplying duct 120 enables the cold air to flow from the ice machine to the chilling chamber 2, such that a cold air supplying duct and a blower fan is not required on a rear wall of the chilling chamber 2 to supply the cold air, thereby simplifying the refrigerator structure and saving electricity.

Further, since the cold air used for freezing the water in the ice machine 50 is discharged to the chilling chamber 2, the ice machine 50 can be supplied with new cold air effectively and thereby can have increased efficiency.

FIGS. 9 to 12 show another embodiment of the present invention.

Referring to FIGS. 9 to 12, an ice machine 50 is installed inside of an ice machine cover 110 of a freezing chamber door 3. The ice machine includes an ice maker 10 and an ice bank 20 as shown in FIG. 5. A cold air is blown from an evaporator 8 to the freezing chamber 3 by a blower fan 9, and the cold air enters the ice maker 10 to freeze water to make ice. The ice is ejected from the ice maker 10 to the ice bank 20.

An openable mold cover 111 is attached to the ice machine cover 110 to protect the inside ice machine 50. The ice machine cover 110 defines a first cold air inlet hole 107 through which the cold air flows from the freezing chamber 1 into the ice machine 50 to freeze the water.

A cold air outlet duct 115 connected with an ice-making chamber of the ice machine 50 is formed in a freezing chamber door dike 173. Also, a first cold air discharge hole 117 is formed in the freezing chamber door dike 173. The cold air of the ice machine 50 is discharged through the cold air outlet duct 115 and the first cold air discharge hole 117.

A blower fan 116 is disposed in the freezing chamber door dike 173 to easily discharge the cold air from the ice machine 50. The easy discharge of the cold air also enables easy inflow of the cold air from the freezing chamber 1 to the ice machine 50, thereby increasing the efficiency of the ice machine 50.

A cold air supplying duct 120 is formed in a chilling chamber door dike 174 in a vertical direction. The cold air supplying duct 120 includes a second cold air inlet hole 121 at one end and a second cold air discharge holes 122 at the other end. The second cold air inlet hole 121 comes into contact with the first cold air discharge hole 117.

Referring again to FIGS. 10 and 11, the second cold air inlet hole 121 is formed in the chilling chamber door dike 174, and the first cold air discharge hole 117 is formed in the freezing chamber door dike 173. The second cold air inlet hole 121 and the first cold air discharge hole 117 are faced with each other when the freezing and chilling chamber doors are closed. The second cold air discharge holes 122 are formed at predetermined positions of the a chilling chamber door liner 108, for example, upper/middle/lower place of the chilling chamber door liner 108. Through the second cold air discharge holes 122, the cold air discharged from the ice machine 50 enters the chilling chamber 2. A damper 190 is disposed in the cold air supplying duct to enable the cold air to flow toward the second cold air discharge holes 122 uniformly, such that the cold air can be evenly distributed through the chilling chamber 2.

Referring again to FIG. 12, a packing member 131 is provided around the joint between the first cold air discharge hole 117 and the second cold air inlet hole 121, in order to prevent cold air leakage. The packing member 131 may be a soft gasket.

In detail, the packing member includes a first gasket 134 and a second gasket 135. The first gasket is attached to the freezing chamber door dike 173 to enclose the first cold air discharge hole 117, and the second gasket 135 is attached to the chilling chamber door dike 174 to enclose the second cold air inlet hole 121. The first and second gaskets 134 and 135 may have a corrugated tube shape. The first and second gasket 134 and 135 comes to contact with each other and pushes each other when the freezing chamber door 3 and the chilling chamber door 4 are closed, such that the cold air can pass through the 117 and second cold air inlet hole 121 without leakage.

Further, magnets 113 are respectively disposed in the first and second gasket. The magnets 113 attracts each other when the freezing chamber door 3 and the chilling chamber door 4 are closed, such that the joint between the first and second gasket 134 and 135 is tightly sealed, thereby preventing the cold air leakage more reliably.

Figure 13:
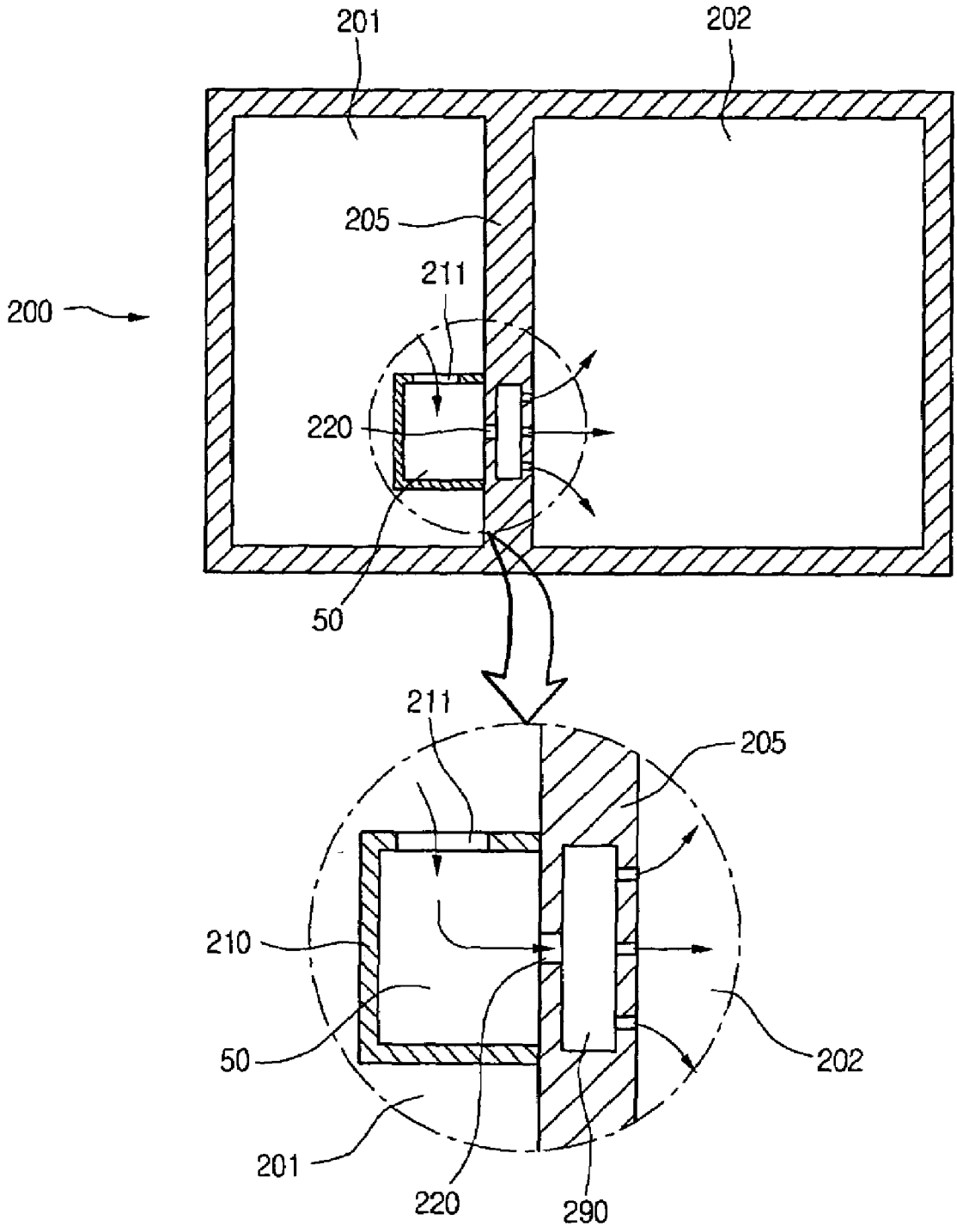
FIG. 13 is a cross sectional view of a refrigerator according to a further another embodiment of the present invention.

FIG. 13 is a cross sectional view of a refrigerator according to a further another embodiment of the present invention.

Referring to FIG. 13, a refrigerator body 200 is divided into a freezing chamber 201 and a chilling chamber 202 by a barrier 205. An ice machine 50 is installed on the barrier 205 in the freezing chamber 201. An ice machine cover 210 encloses the ice machine 50 to protect the ice machine 50. The ice machine cover 210 defines a through hole 211 in which a cold air passes from the freezing chamber 201 to the ice machine 50.

The barrier 205 defines a cold air duct 220 to connect the freezing chamber 201 and the chilling chamber 202. A damper 290 is disposed in the cold air duct 220, and the cold air duct 220 is divided into several branches (three are shown).

In operation, a cold air in the freezing chamber 201 enters the ice machine 50 through the through hole 211 of the ice machine cover 210 to freeze water in the ice machine 50. After freezing the water, the cold air passes through the cold air duct 220 toward the chilling chamber 202. The flow of the cold air from the ice machine to the chilling chamber 202 is controlled by the damper 290 disposed in the cold air duct 220.

In this embodiment, the cold air duct 220 is defined in the barrier 205, such that an additional cold air passage is not required to supply the cold air to the chilling chamber, thereby simplifying the structure of the refrigerator.

As described above, the cold air path structure from the ice machine to the chilling chamber is designed such that after freezing the water of the ice machine the cold air flows to the chilling chamber instead of re-circulating in the freezing chamber. Therefore, an additional cold air passage is not required to supply the cold air to the chilling chamber, thereby simplifying the structure of the refrigerator and reducing power consumption.

Further, since the cold air of the ice machine is quickly discharged to the chilling chamber after freezing the water, the cold air of the freezing chamber can be easily sucked to the ice machine, thereby increasing the efficiency of the ice machine.

Furthermore, the cold air passage of the present invention is formed inside the barrier and chamber doors, thereby increasing available spaces of the freezing chamber and the chilling chamber.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cold air path structure of a refrigerator having a barrier to define a freezing chamber and a chilling chamber and an ice machine inside of a freezing chamber door, comprising:

a cold air outlet duct defined at the ice machine to discharge cold air from the ice machine;

a cold air supplying duct defined in the barrier to supply the cold air from the cold air outlet duct to the chilling chamber; and a packing member for sealing a joint between the cold air outlet duct and the cold air supplying duct.

2. The cold air path structure according to claim 1, wherein the cold air supplying duct is extended along the barrier.

3. The cold air path structure according to claim 1, wherein the cold air supplying duct comprises a damper to control the amount of the cold air flowing to the chilling chamber.

4. The cold air path structure according to claim 1, wherein the cold air supplying duct is divided into a plurality of branches along the barrier to uniformly distribute the cold air through the chilling chamber.

5. The cold air path structure according to claim 1, wherein the cold air outlet duct and the cold air supplying duct are detachably connected and of which joint has a concave or convex shape.

6. The cold air path structure according to claim 1, further comprising a blower fan at the cold air outlet duct and/or the cold air supplying duct to blow the cold air.

7. The cold air path structure according to claim 1, further comprising:

an ice machine cover at the freezing chamber door to accommodate the ice machine; and an openable mold cover attached to the ice machine cover to protect the ice machine.

8. A cold air path structure of a refrigerator having an barrier to define a freezing chamber and a chilling chamber and an ice machine inside of a freezing chamber door, comprising:

a cold air outlet duct defined from the ice machine into a freezing chamber door;

a cold air supplying duct defined in a chilling chamber door to supply an cold air from the cold air outlet duct to the chilling chamber; and a packing member for sealing a joint between the cold air outlet duct and the cold air supplying duct.

9. The cold air path structure according to claim 8, wherein the cold air supplying duct comprises a damper to control the amount of the cold air flowing to the chilling chamber.

10. The cold air path structure according to claim 8, wherein the cold air outlet duct and the cold air supplying duct are detachably connected and of which joint has a concave or convex shape.

11. The cold air path structure according to claim 8, wherein the packing member is flexible and provided with a magnet to securely connect the cold air outlet duct and the cold air supplying duct for the sealing.

12. The cold air path structure according to claim 11, wherein the packing member has a corrugated tube shape and disposed at the joint.

13. The cold air path structure according to claim 8, further comprising a blower fan at the cold air outlet duct and/or the cold air supplying duct to blow the cold air.

14. The cold air path structure according to claim 8, wherein the cold air supplying duct is divided into a plurality of branches along the chilling chamber door to uniformly distribute the cold air through the chilling chamber.

15. A cold air path structure of a refrigerator having a barrier to define a freezing chamber and a chilling chamber and an ice machine inside of a freezing chamber door, comprising:

either (1) a cold air outlet duct defined at the ice machine to discharge cold air from the ice machine; and a cold air supplying duct defined in the barrier to supply the cold air from the cold air outlet duct to the chilling chamber; or (2) a cold air outlet duct defined from the ice machine into a freezing chamber door; and a cold air supplying duct defined in a chilling chamber door to supply an cold air from the cold air outlet duct to the chilling chamber; and a packing member for sealing a joint between the cold air outlet duct and the cold air supplying duct.

* * * * *